US012102187B2

(12) United States Patent
Haire

(10) Patent No.: US 12,102,187 B2
(45) Date of Patent: Oct. 1, 2024

(54) ARTICLES OF FOOTWEAR

(71) Applicant: FRANKIE4 IP 1 Pty Ltd, Indooroopilly (AU)

(72) Inventor: Caroline Rose Haire, Indooroopilly (AU)

(73) Assignee: FRANKIE4 IP 1 Pty Ltd (AU)

( * ) Notice: Subject to any disclaimer, the term of this patent is extended or adjusted under 35 U.S.C. 154(b) by 255 days.

(21) Appl. No.: 17/630,998

(22) PCT Filed: Jul. 31, 2020

(86) PCT No.: PCT/AU2020/050790

§ 371 (c)(1),
(2) Date: Jan. 28, 2022

(87) PCT Pub. No.: WO2021/016675

PCT Pub. Date: Feb. 4, 2021

(65) Prior Publication Data

US 2023/0270201 A1 Aug. 31, 2023

(30) Foreign Application Priority Data

Aug. 1, 2019 (AU) ..... 2019902758
Aug. 1, 2019 (AU) ..... 2019902766

(51) Int. Cl.
*A43B 7/14* (2022.01)
*A43B 5/12* (2006.01)
(Continued)

(52) U.S. Cl.
CPC ..... *A43B 9/00* (2013.01); *A43B 5/12* (2013.01); *A43B 7/144* (2013.01); *A43B 7/145* (2013.01); *A43B 7/16* (2013.01); *A43B 13/18* (2013.01)

(58) Field of Classification Search
CPC ..... A43B 7/145; A43B 7/1463; A43B 7/1464; A43B 7/16
(Continued)

(56) References Cited

U.S. PATENT DOCUMENTS 3,124,887 A * 3/1964 Vassar ..... A43B 7/16 D24/192
3,442,031 A * 5/1969 Antell ..... A43B 3/26 36/43
(Continued)

FOREIGN PATENT DOCUMENTS

EP 2462827 A2 6/2012
GB 420216 A 11/1934
WO 2000/070984 A1 11/2000

OTHER PUBLICATIONS

International Preliminary Report on Patentability, dated May 11, 2021, for International Application No. PCT/AU2020/050790. (9 pages).
(Continued)

*Primary Examiner* — Marie D Bays
(74) *Attorney, Agent, or Firm* — Rowan Tree Law Group, PLLC; Magdalena M. Fincham

(57) ABSTRACT

An article of footwear comprising: a sole;
an upper, attached to the sole; and
a full length footbed located inside the upper;
wherein a portion of an underside of the full length footbed is attached relative to the sole with an underside of a forward portion of the full length footbed being unattached for placement of a forefoot cushion thereunder and/or an underside of a rearward portion of the full length footbed being unattached for placement of a heel raise thereunder.

13 Claims, 6 Drawing Sheets

(51) Int. Cl.

| | |
|---|---|
| ***A43B 7/144*** | (2022.01) |
| ***A43B 7/145*** | (2022.01) |
| ***A43B 7/16*** | (2006.01) |
| ***A43B 9/00*** | (2006.01) |
| ***A43B 13/18*** | (2006.01) |

(58) Field of Classification Search
USPC ..... 36/44, 43, 97
See application file for complete search history.

(56) References Cited

U.S. PATENT DOCUMENTS

| | | | | |
|---|---|---|---|---|
| 6,205,685 | B1 * | 3/2001 | Kellerman | A43B 1/0072 36/44 |
| 11,051,577 | B1 * | 7/2021 | Cheney | A43B 17/006 |
| 2006/0107552 | A1 * | 5/2006 | Clark | A43B 3/26 36/31 |
| 2006/0107553 | A1 * | 5/2006 | Clark | A43B 13/383 36/31 |
| 2006/0288613 | A1 * | 12/2006 | Lo | A43B 7/1415 36/44 |
| 2008/0127518 | A1 * | 6/2008 | Byrne | A43B 7/1445 36/97 |
| 2012/0330795 | A1 | 12/2012 | Hayes | |
| 2015/0164178 | A1 * | 6/2015 | Lee | A43B 13/181 36/114 |
| 2018/0110284 | A1 * | 4/2018 | Granger | A43B 7/1445 |
| 2021/0137213 | A1 * | 5/2021 | Stockbridge | A43B 7/1445 |
| 2022/0248806 | A1 * | 8/2022 | Haire | A43B 7/144 |

OTHER PUBLICATIONS

International Search Report and Written Opinion, dated Oct. 20, 2020, for International Application No. PCT/AU2020/050790. (9 pages).

* cited by examiner

ARTICLES OF FOOTWEAR

RELATED APPLICATIONS

The present application claims priority from Australian provisional patent applications 2019902758 and 2019902766, both filed 1 Aug. 2019, the disclosures of which are hereby incorporated herein by reference.

TECHNICAL HELD

The present invention relates to an article of footwear that is adapted for adjustable fitting for a wearer.

BACKGROUND

Any references to methods, apparatus or documents of the prior art are not to be taken as constituting any evidence or admission that they formed, or form part of the common general knowledge.

Embodiments of the present application will be primarily described in relation to a thin soled shoe such as a ballet flat however such description is for the purpose of understanding an example embodiment only. The invention is not limited to ballet flats and may be used in the context of other articles of footwear from other styles including moccasins, court shoes and medium height shoes, for both males and females and also for children.

Ballet flats are a type of slip-on shoe that has been popular for decades. Some reasons for the enduring demand for ballet flats are that they are easy to slip on and off the foot, are light to wear and are compact and thus readily packed when travelling.

FIG. 1 is a view of the top, front and right hand side of a version of a right-foot ballet flat 1. FIG. 2 is a view in direction 3 of FIG. 1 of a section of ballet flat 1 along the line A-A' of FIG. 1.

The ballet flat 1 has a thin sole 5 of hardwearing, resilient synthetic or leather material. As can be seen in FIG. 2, a low profile heel member 7 of synthetic material is located above heel region 9 of the sole 5 so that a heel with a low height "h" is presented externally on the underside of the sole 5. In some, more traditional, versions of ballet flats the heel member 7 will be lacking so that the underside of the sole is flatter and the height "h" is simply the thickness of sole 5.

Ballet flat 1 includes an upper 11 which is strapless and without laces. Lower peripheral portions 13, of the upper are turned back over the heel member 7 and/or sole 5 and glued and/or stitched, stapled or otherwise suitably fastened thereto. A sock liner 15 is glued or otherwise suitably attached inside the ballet flat over heel member 7 and sole 5. It will be realized that there are other ways in addition to gluing by which shoe parts are fastened to each other such as via stitching or moulding or stapling or nailing. It will also be realized that some shoes don't have a 'sockliner'. Other components are also typically present in a ballet flat such as a liner on the inside of the upper, which need not be discussed in order to describe the various embodiments that will be explained herein.

Although ballet flats are a popular form of casual footwear they have some drawbacks and it would be advantageous to address if not all then at least some of them. A fundamental problem with many types of footwear including ballet flats is that they tend to be uncomfortable to wear. In relation to the example of ballet flats, the lack of comfort is exhibited in a few ways. Firstly, wearers may find that after wearing the ballet flats for a few hours their feet feel sore and that soreness may develop into a general sense of foot pain. A second problem is that ballet flats are often not well fitted because the wearer tends to choose an undersized ballet flat for their foot so that the ballet flat stays on and does not inadvertently slip off. To some extent this is a by-product of the fact that most ballet flats do not have straps or laces to assist in fitting the ballet flat comfortably and securely to the wearer's foot. An additional problem that may arise when the wearer buys a ballet flat corresponding to their normal shoe sizes is that they find the shoe doesn't "hold on" to the foot so that the wearer tends to "claw" their toes (or make other biomechanically unsound movements) in an attempt to ensure that the shoe does not slip off.

It is an object of the present invention to address at least one of the problems of the prior art that have been discussed above.

SUMMARY OF THE INVENTION

According to a first aspect there is provided an article of footwear comprising:

a sole;

an upper, attached to the sole; and a full length footbed located inside the upper;

wherein a portion of an underside of the full length footbed is attached relative to the sole with an underside of a forward portion of the full length footbed being unattached for placement of a forefoot cushion thereunder and/or an underside of a rearward portion of the full length footbed being unattached for placement of a heel raise thereunder.

In an embodiment the portion of the underside of the full length footbed that is attached is located between the rearward portion for placement of the heel raise thereunder and the forward portion for placement of the forefoot cushion thereunder.

In an embodiment the underside of the rearward portion of the full length footbed is attached within the upper; wherein the underside of the rearward portion that is attached corresponds to heel and arch portions of the full length footbed.

In an embodiment the heel raise is attached within the upper.

In an embodiment the upper and the underside of the rearward portion of the full length footbed are attached over the heel raise.

In an embodiment the full length footbed is contoured for supporting an underside of a wearer's foot.

In an embodiment the portion of the underside of the full length footbed that is attached relative to the sole comprises a midsection portion along a length of the full length footbed.

In an embodiment an attachment of the underside of the midsection portion comprises a gluing attachment or a stapling attachment or a sewing attachment or any other suitable attachment means that is typically used in shoemaking.

According to a further aspect there is provided a shoe assembly comprising:

a container;

a first article of footwear in the container according to any one of the preceding claims; and one or more forefoot cushions for placement under the forward portion of the full length footbed and/or one or more heel raises for placement under the rearward portion of the full length footbed.

In an embodiment the assembly further includes a second article of the footwear wherein the first article of footwear and the second article of footwear comprise left foot and right foot pieces of a pair of footwear.

In an embodiment the one or more forefootushions include forefoot cushions of differing thicknesses.

In an embodiment the one or more forefoot cushions include forefoot cushions of differing degrees of firmness.

In an embodiment the one or more heel raises include heel raises of differing thicknesses.

In an embodiment the one or more heel raises include heel raises of differing degrees of firmness.

In a further aspect there is provided a method for adjusting an article of footwear for improved fit, the article of footwear comprising a sole with an upper attached thereto and a full length footbed located inside the upper, wherein a portion of an underside of the full length footbed is attached relative to the sole with an underside of a forward portion of the full length footbed being unattached for placement of a forefoot cushion thereunder and/or an underside of a rearward portion of the full length footbed being unattached for placement of a heel raise thereunder, the method comprising:

selecting at least one forefoot cushion from one or more forefoot cushions; and/or selecting at least one heel raise from one or more heel raises; and placing the selected forefoot cushion and/or the selected heel raise under the forward portion and/or the rearward portion of the full length footbed respectively.

In an embodiment the method includes:

test wearing the article of footwear with the selected forefoot cushion in place; and repeating said selecting, placing and test wearing until an optimal one or more of the one or more forefoot cushions is placed under the forward portion of the full length footbed for optimal fit of a foot of the wearer.

In an embodiment the method includes:

test wearing the article of footwear with the selected heel raise in place; and repeating said selecting, placing and test wearing until an optimal one or more of the one or more heel raises is placed under the rearward portion of the full length footbed for a foot of the wearer.

According to another aspect there is provided a method of adjusting an article of footwear for improved fit, the article of footwear being of a type having a sole with an upper attached thereto and a heel raise extending upwardly for elevating a heel of a wearer within the upper, with a full length footbed located over the heel raise and sole, the method comprising:

selecting at least one forefoot cushion from one or ore forefoot cushions;

placing the selected forefoot cushion under a forefoot portion of the full length footbed; test wearing the article of footwear with the selected forefoot cushion in place; and repeating said selecting, placing and test wearing until an optimal one or more of the one or more forefoot cushions is placed under the forefoot portion for best fit of a foot of the wearer.

In an embodiment the full length footbed is a contoured full length footbed.

According to another aspect there is provided a method of fitting an article of footwear as previously set forth for a wearer including locating a forefoot cushion and/or a heel raise under the forward and/or rearward portions of the full length footbed for achieving a fit to suit the wearer of the article of footwear.

According to a further aspect of the present invention there is provided an article of footwear including a full length footbed fastened in the article of footwear that has forward and/or rearward portions that can be lifted up for placement of a forefoot cushion and/or a heel raise respectively thereunder.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
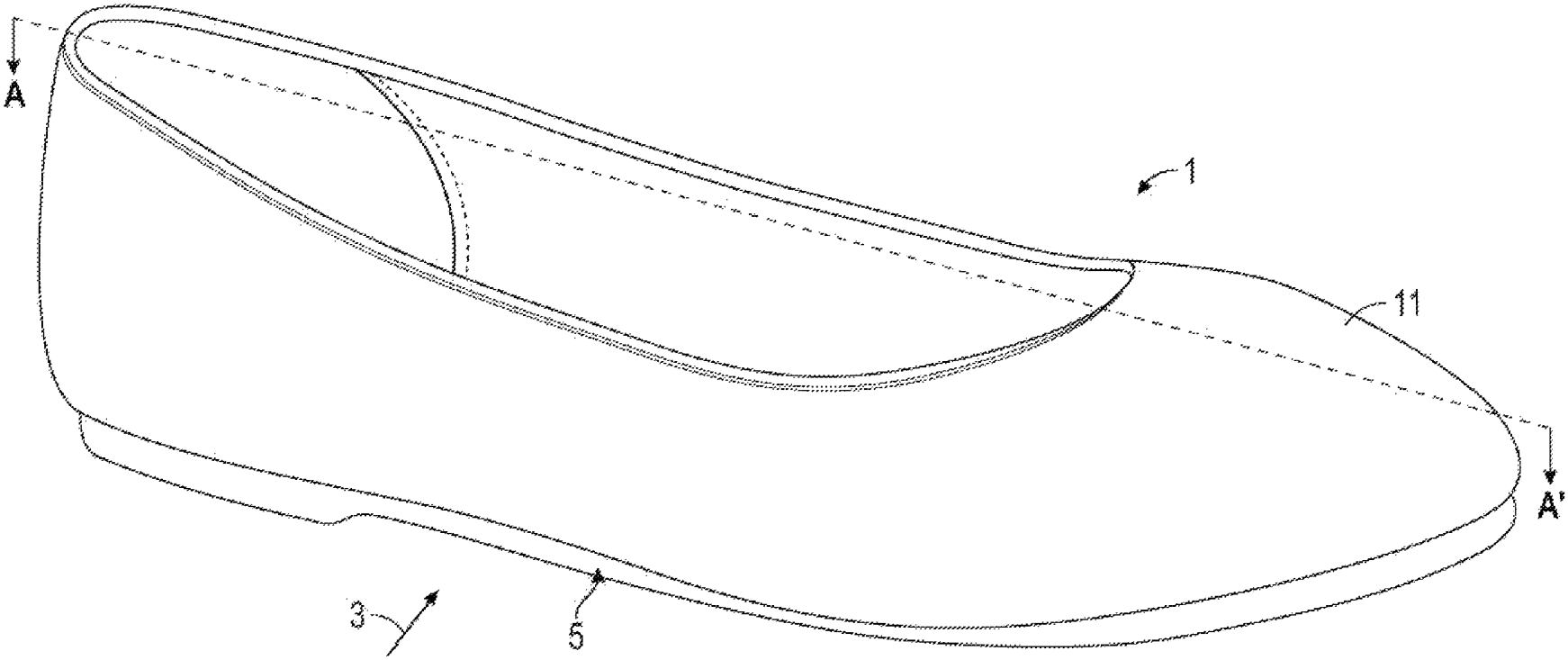
FIG. 1 depicts a typical prior art thin soled, low heeled article of footwear in the form of a ballet flat.
Figure 2:
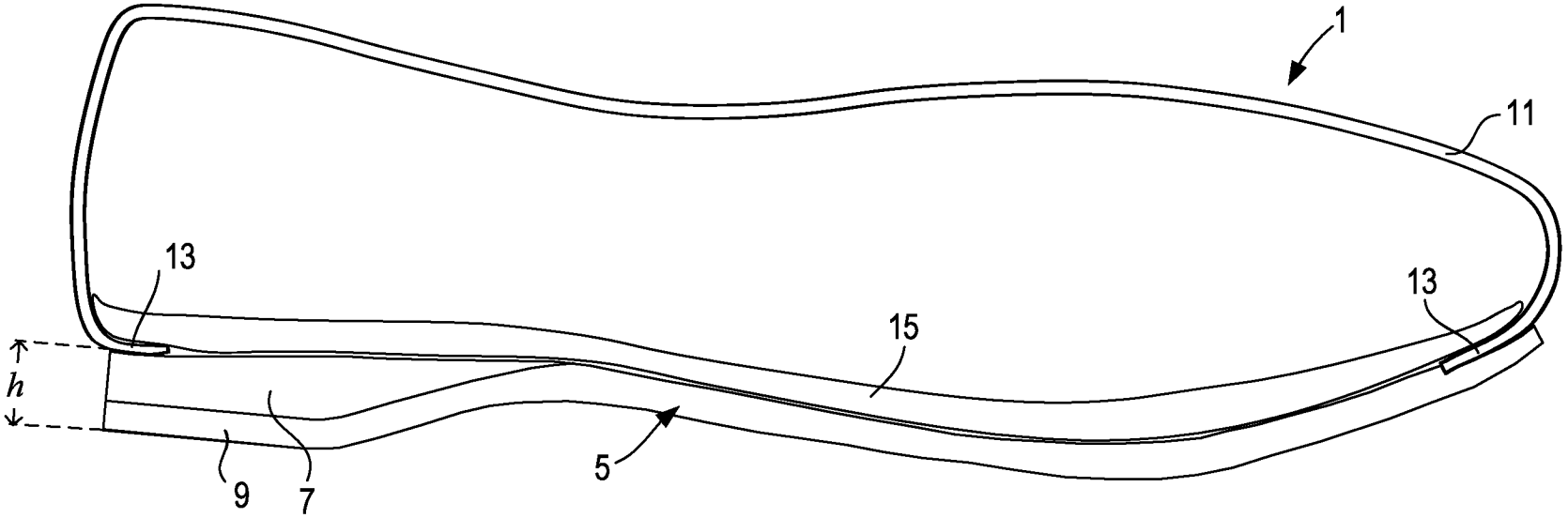
FIG. 2 is a longitudinal cross section along the ballet flat of FIG. 1.
Figure 2A:
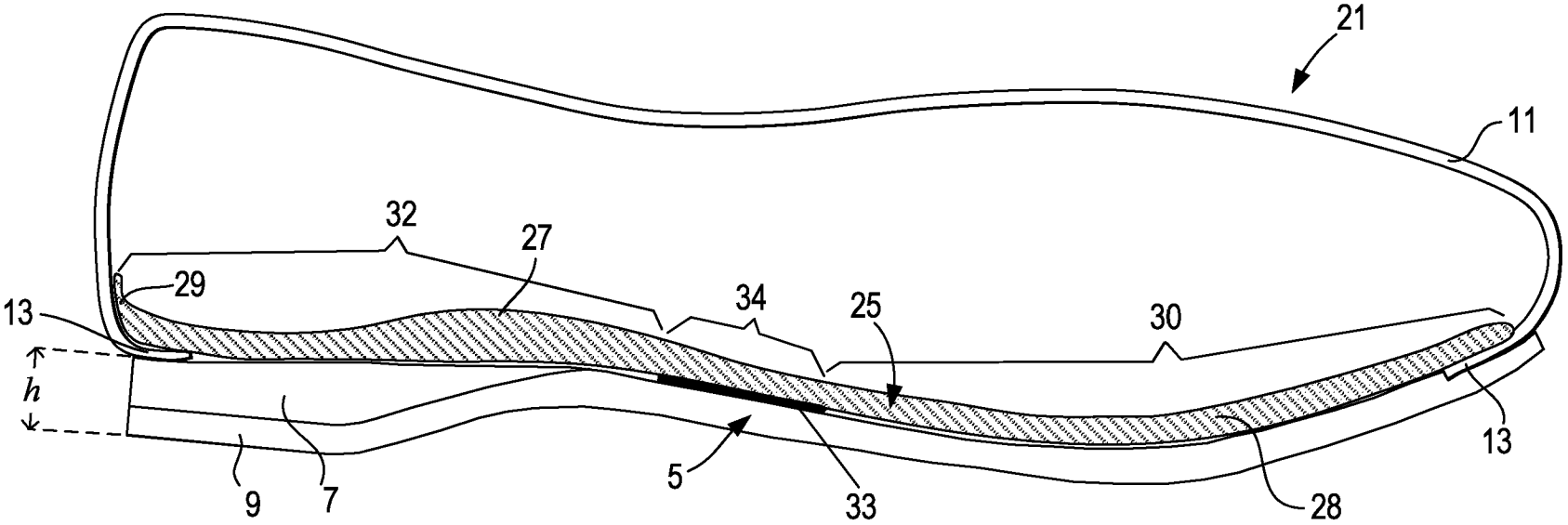
FIG. 2A is a cross section along an article of footwear according to an embodiment of the present invention without inclusion of either a forefoot cushion or of a heel raise.

Referring now to FIG. 2A, there is shown in cross section a shoe 21 being an article of footwear according to a first embodiment. Shoe 21 includes a sole 5 that includes a heel member 7 that presents a small heel height "h" on the outside of the sole heel portion 9 as indicated in FIG. 2A. In other embodiments the raised portion 7 may not be present so that sole 5 is flat, or close to flat, so that there is no discernible height difference between heel portion 9 and the remainder of the underside of the sole 5. The shoe 21 includes a full length footbed 25 located inside the upper 11 and over the sole 5.

Footbed 25 is contoured for supporting an underside of a wearer's foot. For example, the contouring of footbed 25 includes a thickened arch portion 27 and a rear heel support portion 29 that are provided to support the wearer's foot arch and heel. The footbed 25 is preferably made of a soft and resilient synthetic substance such as polyurethane or EVA.

In the present embodiment an underside of a midsection portion 34 of the full length footbed 25 is attached either directly or indirectly to the sole 5 within the upper 11, or in other words the footbed 25 is attached relative to the sole 5. The attachment 33 of the underside of midsection portion 34 may comprise gluing, stapling, sewing or any other suitable technique that is typically used in shoemaking. Consequently the footbed 25 is non-removable, unless pulled with a deliberately applied force.

The rear footbed portion 32 includes the heel and arch portions 29, 27 whereas the forward portion 30 comprises a forefoot portion 28 of the footbed 25.

An underside of the forward portion 30 of the footbed 25 is unattached and thus the forward portion 30 of the footbed 25 can be tilted up or pulled back so that an area under the forward portion is accessible.

Similarly, in the presently described embodiment, an underside of a rearward portion 32 of the full length footbed 25 is unattached and thus the rearward portion 32 can be tilted up or pulled back so that an area under the rearward portion is accessible.

Figure 3:
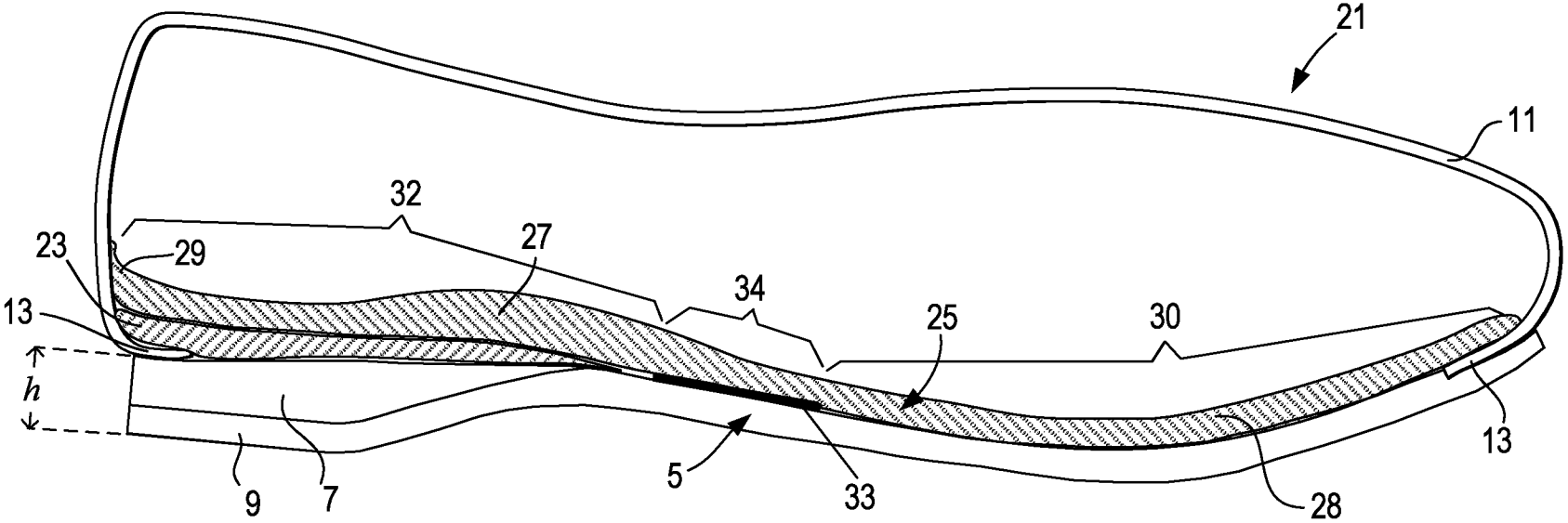
FIG. 3 is a further cross section of the article of footwear of FIG. 2A with inclusion of a heel raise.

Referring now to FIG. 3, the shoe 21 is shown in a state of adjustment wherein the rearward portion 32 has been pulled up and forward and a heel raise 23 has been located thereunder before placing the rearward portion 32 back down so that it covers the heel raise 23. Heel raise 23 has a thickness so that it extends upwardly for elevating a wearer's heel in the upper. It will be realized that heel raises of differing parameters, such as differing thicknesses, for example to compensate for legs of different lengths, may be used and also of differing degrees of firmness as desired.

Figure 4:
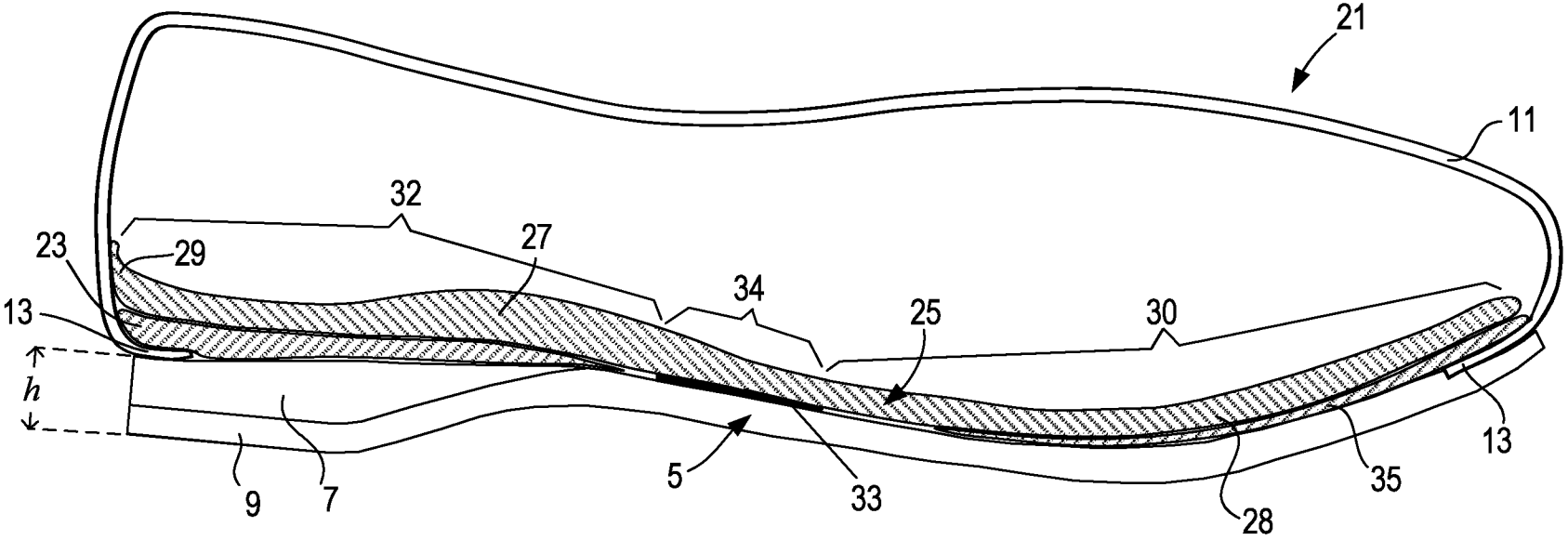
FIG. 4 is a further cross section of the article of footwear of FIG. 3 with inclusion of a forefoot cushion and a heel raise.

Referring now to FIG. 4, the shoe 21 is shown in a further state of adjustment wherein the forward portion 30 of footbed 25, which includes forefoot portion 28, has been pulled up and back and a forefoot cushion 35 has been located thereunder. The forefoot cushion 35 may be located under the forefoot portion 28 when a wearer with a narrow foot wishes to raise the forward portion of the footbed 25 to reduce the effective width of the forward portion of upper 11 in 5 order to provide a better fit for the wearer's foot in the shoe 21.

An added benefit of forefoot cushion 35 is that it is beneficial for wearers who need extra cushioning under their forefoot, for example, wearers that suffer from plantar metatarsal fat pad atrophy. Another benefit is that wearers who experience foot swelling from time to time may take out the forefoot cushion 35 during periods of swelling to accommodate the swollen feet. Furthermore some people have asymmetric feet in which case a shoe for one foot will be best fitted with the forefoot cushion in place whilst a shoe for the other foot will be best fitted with the forefoot cushion left out or with a thinner forefoot cushion installed.

In an embodiment a method is provided of adjusting an article of footwear for improved fit. The method is particularly relevant to shoes such as a ballet flat being an article of footwear 21 that has a non-existent or low profile heel with an upper 11 attached thereto with a footbed 25 located in the upper and, in one embodiment, having a midsection 34 attached relative to the sole by attachment 33. The method involves selecting a forefoot cushion 35 from one or more forefoot cushions, (if only one forefoot cushion is available then that will be the only selection possible) and preferably a plurality of forefoot cushions of differing qualities such as thickness and degree of firmness.

Assuming that two or more forefoot cushions of differing qualities are available then the selection is made taking into account factors such as how loose the wearer's foot initially feels in the ballet flat 21 without a forefoot cushion having been inserted, Once a forefoot cushion 35 has been selected it is then placed under the forefoot portion 28 of the footbed 25. The wearer can then test-wear the ballet flat 21 with the selected forefoot cushion in place. If the inserted forefoot cushion 35 makes the fitting too tight or if it remains too loose then it is removed and a further selection of another forefoot cushion of a different thickness is made and inserted into place and then tested. The procedure is repeated until an optimal fit has been achieved. In some less preferred embodiments the method includes using an optimal number of thin forefoot cushions stacked on each other to arrive at a desired fitting.

The method can further include selecting a heel raise 23 from one or more heel raises, (if only one heel raise is available then that one will be the only possible selection) and preferably a plurality of heel raises of differing qualities such as thickness, degree of firmness and angle of tilt. Where two or more heel raises of differing qualities are available the selection is made taking into account factors such as the presence of a leg length disparity of the user and whether the user has a tender heel so that a soft heel raise is particularly indicated. Accordingly the heel raise selection may be made to optimise foot function and/or foot comfort for the wearer.

Another example is that the heel raise can be at an angle such as at a varus angle to further tilt the foot to reduce pronation. Once a heel raise 23 has been selected it is then placed under the rearward portion 32 of the footbed 25. The wearer can then test-wear the ballet flat 21 with the selected heel raise in place. If the inserted heel raise 25 is sub-optimal, i.e. not providing good foot function and/or foot comfort, then it is removed and a further selection of another heel raise is made and inserted into place and then tested. The procedure is repeated until an optimal one or more heel raises have been selected.

It will be realized that in some situations only one or other of a forefoot cushion and a heel raise are needed. In other situations both will be desirable and in some other situations neither are required.

Embodiments of the invention include versions wherein the heel raise 23 is permanently attached relative to the sole 5 and wherein the attachment of the footbed 25 is to heel raise 23, rather than by midsection 30. There may also be embodiments of the invention in which the heel raise 23 is formed as a single piece with the footbed 25 and attached relative to the sole 5.

Figure 5:
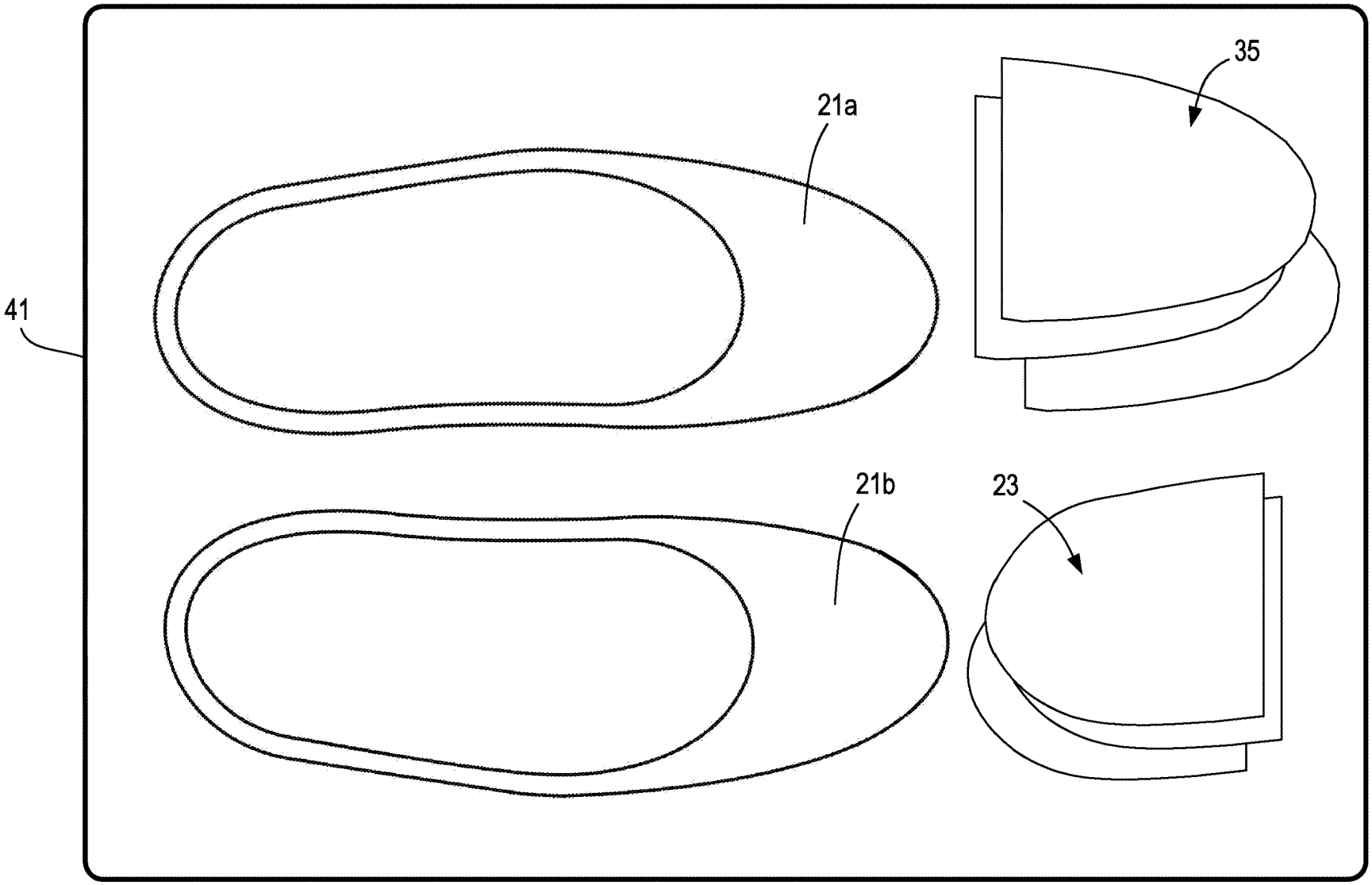
FIG. 5 is a top view of a shoe assembly according to a further embodiment of the invention.

In order to facilitate the performance of the method by a user in their own home a shoe assembly may be provided according to a further embodiment. With reference to FIG. 5, the shoe assembly includes a container 41, which will typically be a shoe box but could be another type of container such as a padded mail bag for example. The container 41 holds an article of footwear, or, more typically, a pair of shoes 21*a*, 21*b*. Each shoe may be of a type that has been exemplified with reference to article of footwear 21 of FIGS. 2 and 3.

That is, in one embodiment the shoe 21 has a sole 5, an upper 11 fastened directly or indirectly to the sole and a full length footbed 25 located within the upper 11. A portion 34 of an underside of the full length footbed 25 is attached relative to the sole 5, i.e. either directly or indirectly to the sole 5. In an embodiment discussed with reference to FIG. 2A, an underside of forward portion 30 of the full length footbed 25 is unattached for placement of a forefoot cushion 35 thereunder and a rearward underside portion 32 of the full length footbed 25 is unattached for placement of a heel raise thereunder. The container 41 also includes one or more forefoot cushions 35 for placement under the forward portion 30 of the full length footbed and one or more heel raises 23 for placement under the rearward portion 32 of the full length footbed 25.

The container may contain differing heel raises having different parameters or qualities to each other to allow the customer to customize the function of the ballet flat.

Consequently, it will be realized that embodiments described herein allow a consumer to purchase a pair of shoes 11, such as ballet flats that have a footbed 25 with a midsection 30 that is attached relative to the shoe's sole so that forward and rearward portions 30 and 32 of the footbed 25 may be lifted up to respectively allow for placement of a selected forefoot cushion 35 from one of a number of forefoot cushions and heel raise 23 from one of a number of heel raises thereunder. The wearer can then try the ballet flats on and by testing forefoot cushions of different thicknesses, or even more or less numbers of thin forefoot cushions, placed under the forward portion of the footbed, arrive at an optimal fitting for their particular foot.

Similarly, the wearer can remove the heel raise completely if it is no longer needed, for example they may use it to assist with recovery from an injury and then remove it once recovered. If the wearer has a leg length difference then removing the heel raise under the longer leg will assist in compensating for the difference in leg length. Furthermore the container may include an alternative heel raise that is of a design more suited to the wearer's recovery or biomechanical needs so that the wearer may swap the heel raise to suit their needs as required.

Furthermore, embodiments of the present invention provide articles of footwear that fit well and which may include a heel raise that is not externally visible and a full length footbed that is attached relative to the sole and which allows for placement of a forefoot cushion beneath a forward portion of the footbed, without substantially compromising the aesthetic appearance of a the footwear.

Whilst embodiments of the invention have been described primarily in relation to an article of footwear in the form of a thin soled article of footwear such as a ballet flat, embodiments of the invention may be used to provide medium height shoes and shoes for each of women, children and men.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the scope of the invention.

The invention claimed is:

1. An article of footwear comprising:

a sole;

an upper, attached to the sole;

a non-removable full length footbed located inside the upper; and a heel raise attached within the upper, the heel raise extending upwardly and configured to elevate a wearer's heel in the upper; and one or more forefoot cushions;

wherein the non-removable full length footbed includes a portion of an underside of the non-removable full length footbed attached relative to the sole and an underside of a forward portion of the non-removable full length footbed unattached and configured to be tiltable upwardly to allow placement of the one or more forefoot cushions thereunder, and wherein the non-removable full length footbed is contoured for supporting an underside of a wearer's foot and the contoured non-removable footbed includes a thickened arch portion and a rear heel support portion to support the wearer's foot.

2. The article of footwear of claim 1, wherein an underside of a rearward portion of the non-removable full length footbed is attached within the upper, wherein the underside of the rearward portion that is attached corresponds to heel and arch portions of the non-removable full length footbed.

3. The article of footwear of claim 1, wherein the non-removable full length footbed is attached along a midsection thereof to the sole.

4. The article of footwear of claim 1, wherein the one or more forefoot cushions are independent of the non-removable full length footbed, and are selectively positionable and removable relative to the non-removable full length footbed and the sole.

5. A shoe assembly comprising:

a container;

a first article of footwear in the container comprising:

a first sole;

a first upper, attached to the first sole;

a first non-removable full length footbed located inside the first upper; and a first heel raise attached within the first upper, the first heel raise extending upwardly and configured to elevate a wearer's heel in the first upper, wherein the first non-removable full length footbed includes a portion of an underside of the first full length footbed attached relative to the sole and an underside of a forward portion of the full length footbed unattached and tiltable upwardly for placement of a forefoot cushion thereunder, and wherein the non-removable full length footbed is contoured for supporting an underside of a wearer's foot and the contoured non-removable footbed includes a thickened arch portion and a rear heel support portion to support the wearer's foot; and one or more forefoot cushions for placement under the forward portion of the first non-removable full length footbed.

6. The assembly of claim 5, further including:

a second article of footwear comprising:

a second sole;

a second upper, attached to the second sole;

a second non-removable full length footbed located inside the second upper; and a second heel raise attached within the second upper, the second heel raise extending upwardly and configured to elevate a wearer's heel in the second upper, wherein the second non-removable full length footbed includes a portion of an underside of the second full length footbed attached relative to the sole and an underside of a forward portion of the full length footbed unattached and tiltable upwardly for placement of a forefoot cushion thereunder;

wherein the first article of footwear and the second article of footwear comprise left foot and right foot pieces of a pair of footwear.

7. The assembly of claim 5, wherein the one or more forefoot cushions include forefoot cushions of differing thicknesses.

8. The assembly of claim 5, wherein the one or more forefoot cushions include forefoot cushions of differing degrees of firmness.

9. The assembly of claim 5, wherein the non-removable full length footbed is attached along a midsection thereof to the sole.

10. The assembly of claim 5, wherein the one or more forefoot cushions are independent of the non-removable full length footbed, and are selectively positionable and removable relative to the non-removable full length footbed and the sole.

11. A method for adjusting an article of footwear for a wearer, the article of footwear comprising a sole with an upper attached thereto, a non-removable full length footbed located inside the upper, and a heel raise attached within the upper, wherein the heel raise extends upwardly for elevating the wearer's heel in the upper, and wherein a portion of an underside of the non-removable full length footbed is attached relative to the sole with an underside of a forward portion of the non-removable full length footbed being unattached and tiltable upwardly for placement of a forefoot cushion thereunder, and wherein the non-removable full length footbed is contoured for supporting an underside of a wearer's foot and the contoured non-removable footbed includes a thickened arch portion and a rear heel support portion to support the wearer's foot, the method comprising:

selecting at least one forefoot cushion from one or more forefoot cushions;

placing the selected forefoot cushion under the forward portion of the non-removable full length footbed respectively;

test wearing the article of footwear with the selected forefoot cushion in place; and repeating said selecting, placing and test wearing until an optimal one or more of the one or more forefoot cushions is placed under the forward portion of the non-removable full length footbed for optimal fit of a foot of the wearer.

12. The method of claim 11, further including removing the selected forefoot cushion subsequent to test wearing the article of footwear.

13. The method of claim 12, including a second selected forefoot cushion, and repeating said placing and test wearing.

* * * * *